US010563340B2

(12) United States Patent
Kim et al.

(10) Patent No.: US 10,563,340 B2
(45) **Date of Patent: *Feb. 18, 2020**

(54) DOOR AND CLOTHES TREATING APPARATUS HAVING THE SAME

(71) Applicant: SAMSUNG ELECTRONICS CO., LTD., Suwon-si, Gyeonggi-do (KR)

(72) Inventors: Dong Won Kim, Suwon-si (KR); Jong Hun Sung, Suwon-si (KR); Min Ho Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 215 days.

This patent is subject to a terminal disclaimer.

(21) Appl. No.: 15/229,528

(22) Filed: Aug. 5, 2016

(65) Prior Publication Data

US 2016/0340820 A1 Nov. 24, 2016

Related U.S. Application Data

(63) Continuation of application No. 14/315,847, filed on Jun. 26, 2014, now Pat. No. 9,441,395.

(Continued)

(30) Foreign Application Priority Data

Jul. 1, 2013 (KR) ..... 10-2013-0076652

(51) Int. Cl.
*D06F 39/14* (2006.01)
*E05B 5/00* (2006.01)

(Continued)

(52) U.S. Cl.
CPC ..... *D06F 39/14* (2013.01); *D06F 37/28* (2013.01); *D06F 58/20* (2013.01); *E05B 5/006* (2013.01)

(58) Field of Classification Search
CPC ..... D06F 37/18; D06F 37/28; D06F 39/14; D06F 58/20
See application file for complete search history.

(56) References Cited

U.S. PATENT DOCUMENTS 7,802,855 B2 * 9/2010 Calmeise ..... D06F 39/14 312/228
8,151,603 B2 * 4/2012 Kang ..... D06F 39/14 68/196

(Continued)

FOREIGN PATENT DOCUMENTS

DE 10 2006 29 202 A1 12/2007
EP 1 564 323 A1 8/2005

(Continued)

OTHER PUBLICATIONS

European Search Report dated Feb. 24, 2015 in corresponding European Patent Application No. 14174821.0.

(Continued)

*Primary Examiner* — Catherine A Kelly
(74) *Attorney, Agent, or Firm* — Staas & Halsey LLP

(57) ABSTRACT

A clothes treating apparatus includes a main body having a laundry insertion opening formed on a front side of the main body, and a door to open or close the laundry insertion opening. The door includes a cover frame having a central opening and a side opening elongated in a circumferential direction of the cover frame; a hand receiving member configured to be coupled to the cover frame from a rear side of the cover frame, and having a pocket for receiving a hand of a user; and a cover panel configured to be coupled to the cover frame from a front side of the cover frame to cover the central opening of the cover frame, and having a recessed portion disposed to correspond to the side opening of the cover frame and to provide access to the pocket of the hand receiving member.

13 Claims, 22 Drawing Sheets

Related U.S. Application Data

(60) Provisional application No. 61/841,983, filed on Jul. 2, 2013.

(51) Int. Cl.
*D06F 37/28* (2006.01)
*D06F 58/20* (2006.01)

(56) References Cited

U.S. PATENT DOCUMENTS

| | | | | |
|---|---|---|---|---|
| 8,523,300 | B2 | 9/2013 | Najera Bernal et al. | |
| 8,661,860 | B2 * | 3/2014 | Murrell | D06F 39/14 68/196 |
| 8,979,141 | B2 * | 3/2015 | Lee | D06F 39/14 292/121 |
| 9,441,395 | B2 * | 9/2016 | Kim | D06F 39/14 |
| 2004/0083769 | A1 * | 5/2004 | Kim | D06F 37/28 68/12.02 |
| 2005/0262887 | A1 | 12/2005 | Kim et al. | |
| 2006/0117809 | A1 | 6/2006 | Ha et al. | |
| 2007/0075614 | A1 | 4/2007 | Calmeise | |
| 2011/0023316 | A1 | 2/2011 | Schöne | |
| 2012/0144750 | A1 * | 6/2012 | Sartor | D06F 39/14 49/399 |
| 2013/0232810 | A1 | 9/2013 | Coxon et al. | |
| 2014/0009049 | A1 * | 1/2014 | Sung | D06F 37/28 312/228 |
| 2014/0116096 | A1 * | 5/2014 | Park | D06F 39/14 68/196 |
| 2014/0157676 | A1 * | 6/2014 | Kim | D06F 37/28 49/394 |
| 2014/0191643 | A1 * | 7/2014 | Lee | B29C 45/16 312/326 |
| 2015/0008807 | A1 * | 1/2015 | Kim | D06F 37/28 312/228 |

FOREIGN PATENT DOCUMENTS

| | | | | |
|---|---|---|---|---|
| EP | 2 161 364 | A2 | 3/2010 | |
| EP | 2161364 | A2 * | 3/2010 | D06F 37/10 |
| EP | 2 161 364 | A3 | 1/2011 | |
| KR | 10-2010-0019090 | | 2/2010 | |

OTHER PUBLICATIONS

U.S. Office Action dated Apr. 16, 2015 from U.S. Appl. No. 14/315,847.

U.S. Office Action dated Nov. 3, 2015 from U.S. Appl. No. 14/315,847.

U.S. Advisory Action dated Feb. 4, 2016 from U.S. Appl. No. 14/315,847.

U.S. Notice of Allowance dated May 5, 2016 from U.S. Appl. No. 14/315,847.

U.S. Appl. No. 14/315,847, filed Jun. 26, 2014, Dong Won Kim, Samsung Electronics Co., Ltd.

Korean Office Action dated Sep. 25, 2019 in related Korean Patent Application No. 10-2013-0076652.

* cited by examiner

DOOR AND CLOTHES TREATING APPARATUS HAVING THE SAME

CROSS-REFERENCE TO RELATED APPLICATIONS

This application is a continuation of U.S. application Ser. No. 14/315,847 filed on Jun. 26, 2014, which claims the benefit of Korean Patent Application No. 10-2013-0076652, filed on Jul. 1, 2013 in the Korean Intellectual Property Office and U.S. Provisional Patent Application No. 61/841,983, filed on Jul. 2, 2013 in the USPTO, the disclosures of which are incorporated herein by reference.

BACKGROUND

1. Field

Embodiments of the present disclosure relate to a handle structure of a door to open and close a laundry insertion opening of a clothes treating apparatus.

2. Description of the Related Art

In general, a front surface of a clothes treating apparatus is formed with an opening through which laundry is inserted or taken out, and a door to open and close the opening is rotatably coupled to the front surface of the clothes treating apparatus.

The door is provided with a door handle which allows a user to rotate the door by gripping the door. Such a door handle is generally produced as a separate part from the door and subsequently assembled to the door. However, when the door handle is produced as a separate part to be assembled to the door, there are problems of an increase in material costs according to production of the door handle and deterioration of productivity according to addition of processes for assembly of the door handle to the door.

SUMMARY

Therefore, it is an aspect of the present disclosure to provide a door having an improved structure in which the door is formed integrally with a door handle, and a clothes treating apparatus having the same.

Additional aspects of the disclosure will be set forth in part in the description which follows and, in part, will be apparent from the description, or may be learned by practice of the disclosure.

In accordance with one aspect of the present disclosure, a clothes treating apparatus includes a main body, a laundry insertion opening formed on a front surface of the main body, and a door to open and close the laundry insertion opening, wherein the door includes a holder member rotatably coupled to the front surface of the main body, a transparent member passing through and coupled to the holder member, and a cover member covering a front surface of the holder member to define an external appearance of the door, and the cover member includes a cover frame provided in a shape corresponding to the holder member, a cover panel coupled to a front surface of the cover frame, and a door handle including a protrusion portion formed by protrusion of a portion of the front surface of the cover frame so as to be capable of providing a receiving space in which a user's hand is received, and a recessed portion formed by recessing a portion of a front surface of the cover panel at a position corresponding to the protrusion portion so as to be capable of guiding a user's hand to the receiving space.

The clothes treating apparatus may further include a hand receiving portion which is inserted into the receiving space and is opened at one side of the hand receiving portion such that a user's hand is capable of being received therein.

One side of the protrusion portion corresponding to the opened side of the hand receiving portion may be opened such that the opened side of the hand receiving portion is capable of being exposed.

The cover panel may include a first flange portion formed such that a tip of the cover panel is bent rearward, and the front surface of the cover frame may be provided with an insertion groove into which the first flange portion is inserted.

The cover panel may include a first fastening protrusion extending rearward from a tip of the first flange portion, and the insertion groove may be provided with a through-hole through which the first fastening protrusion passes.

The cover panel may include a first fastening hole formed by penetrating the first fastening protrusion, and the cover frame may include a first fastening hook which extends from a rear surface thereof to be coupled to the first fastening hole.

The cover panel may include a second flange portion formed such that a tip of the recessed portion is bent rearward, a second fastening protrusion extending rearward from a tip of the second flange portion, and a second fastening hole formed by penetrating the second fastening protrusion, and the hand receiving portion may include a second fastening hook coupled to the second fastening hole.

The hand receiving portion may include a first sidewall and a second sidewall which are spaced apart from each other in forward and backward directions of the door to form a first opening and a third sidewall connecting the first and second sidewalls.

The protrusion portion may include a second opening opened at one side thereof corresponding to the first opening such that the first opening is capable of being exposed.

The cover frame may include a first support rib which is bent rearward from one end of the protrusion portion formed with the second opening so that the first sidewall is supported radially outward of the door by the first support rib, and a second support rib which extends rearward from a rear surface of the cover frame such that the third sidewall is supported radially inward of the door by the second support rib.

The hand receiving portion may include a third fastening hook protruding from an outer surface of the second sidewall, and the rear surface of the cover frame may be provided with a third support rib to support the third fastening hook.

The second sidewall and the third support rib may be spaced apart from each other in the radial direction of the door.

The insertion groove may be provided, at an inner surface thereof, with an inclined rib to support the second flange portion.

The inclined rib may include an inclined surface connecting two adjacent inner surfaces of the insertion groove.

A radius of curvature of a front surface of the recessed portion may be substantially equal to a radius of curvature of an inner surface of the second sidewall.

In accordance with another aspect of the present disclosure, a door to open and close an insertion opening of a clothes treating apparatus includes a holder member rotatably coupled to a front surface of a main body of the clothes treating apparatus, a transparent member passing through and coupled to the holder member, and a cover member covering a front surface of the holder member to define an external appearance of the door, wherein the cover member includes a cover frame provided in a shape corresponding to the holder member, a cover panel coupled to a front surface of the cover frame, and a door handle including a first door handle forming portion formed by protrusion of the front surface of the cover frame and a second door handle forming portion formed by recessing a front surface of the cover panel.

The door handle may include a hand receiving portion which is received inside the first door handle forming portion and is coupled to the first door handle forming portion and the second door handle forming portion.

The cover panel may include a flange portion formed such that a tip of the cover panel is bent rearward.

The door may include a first insertion groove formed around the front surface of the cover frame and the first door handle forming portion so as to be capable of receiving the flange portion, and a second insertion groove formed between the cover frame and the hand receiving portion.

One side of the first door handle forming portion may be opened such that a user's hand is capable of being inserted into the hand receiving portion.

The first insertion groove may have a depth varying according to a circumferential direction of the cover frame.

The cover panel may include a plurality of fastening protrusions each of which extends rearward from a tip of the flange portion, the fastening protrusions being spaced apart from each other in a circumferential direction of the cover panel, and the first insertion groove may be provided with a plurality of through-holes through which the plural first fastening protrusions pass, the through-holes being spaced apart from each other in a circumferential direction of the cover frame.

In accordance with a further aspect of the present disclosure, a clothes treating apparatus includes a main body, a drum rotatably arranged inside the main body, an insertion opening formed on a front surface of the main body such that laundry is capable of being inserted into the drum, and a door to open and close the insertion opening, wherein the door includes a door body and a cover panel which is coupled to an insertion groove formed on a front surface of the door body so as to cover the front surface of the door body, and the insertion groove includes at least one inclined rib which protrudes from an inner surface thereof to support an end of the cover panel inserted into the insertion groove.

The inclined rib may include an inclined surface connecting two adjacent inner surfaces of the insertion groove.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
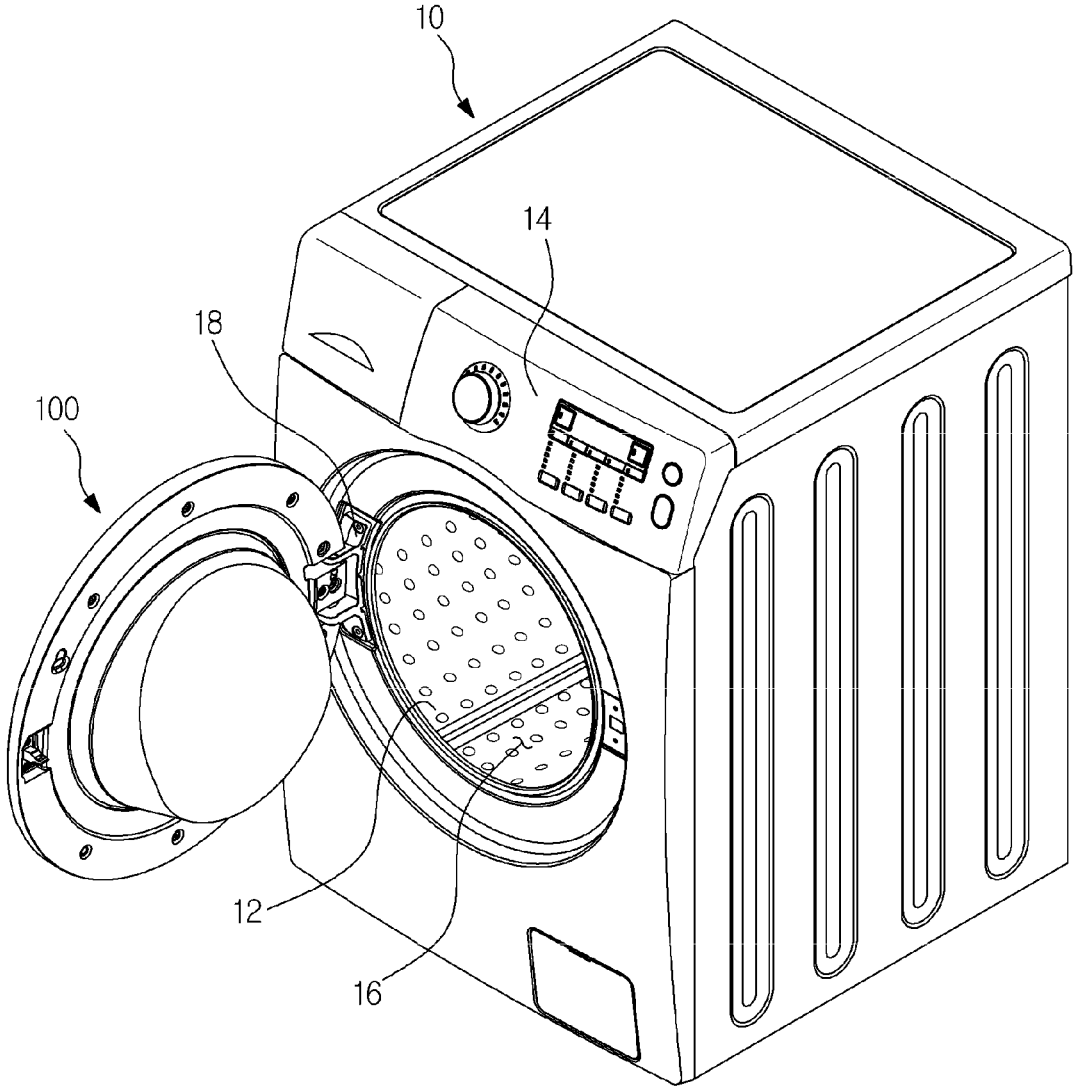
FIG. 1 is a perspective view illustrating an external appearance of a clothes treating apparatus according to an embodiment of the present disclosure.

Reference will now be made in detail to the embodiments of the present disclosure, examples of which are illustrated in the accompanying drawings, wherein like reference numerals refer to like elements throughout.

Figure 2:
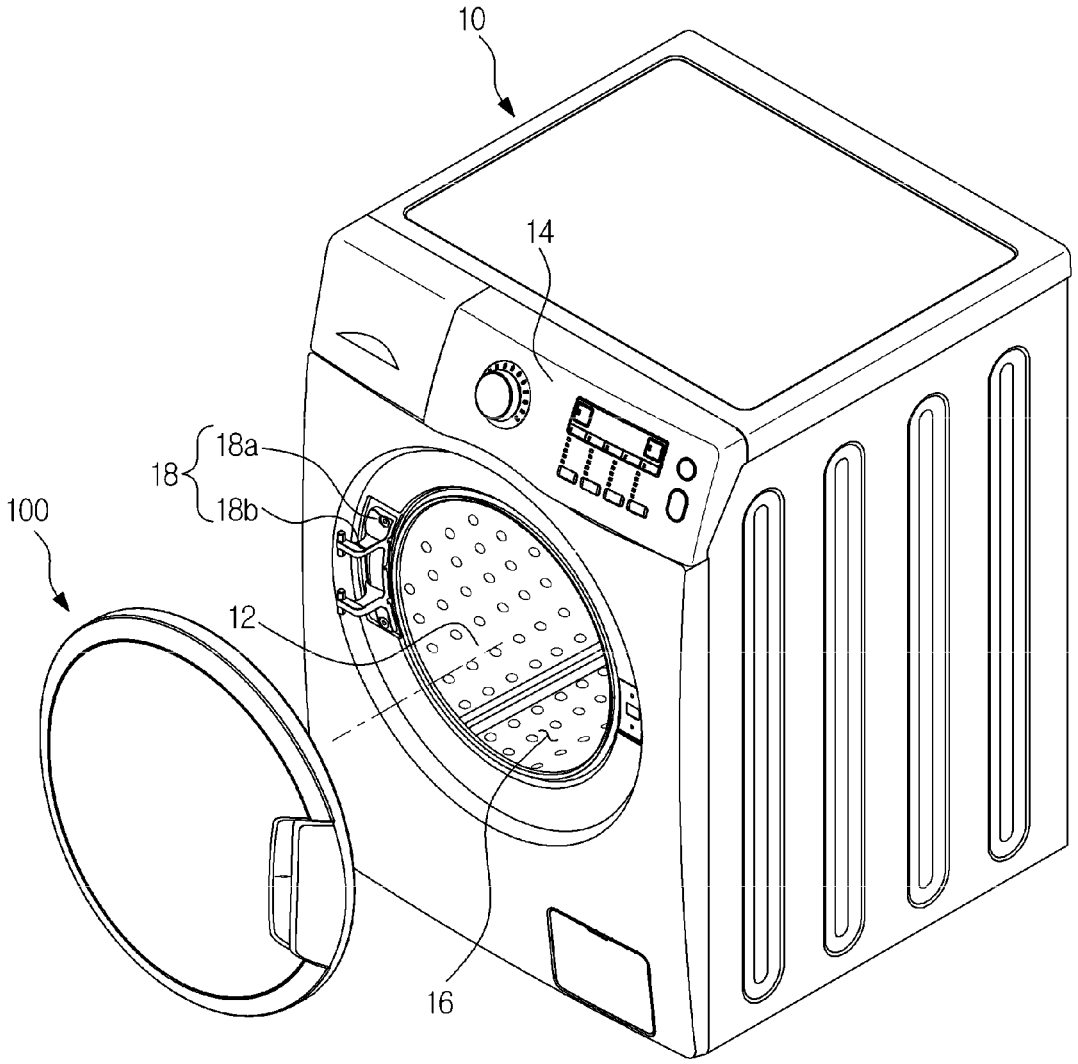
FIG. 2 is a view illustrating a decoupled state of a door from the clothes treating apparatus of FIG. 1.

FIG. 1 is a perspective view illustrating an external appearance of a clothes treating apparatus according to an embodiment of the present disclosure. FIG. 2 is a view illustrating a decoupled state of a door from the clothes treating apparatus of FIG. 1.

As shown in FIGS. 1 and 2, a clothes treating apparatus according to the present disclosure includes a main body 10 defining an external appearance thereof, a tub (not shown) installed inside the main body 10 to store wash water, and a drum 12 rotatably installed inside the tub for washing of laundry.

The main body 10 is provided, at a front upper portion thereof, with a control panel assembly 14 which may control operation of the clothes treating apparatus by a user.

The main body 10 is formed, at a front surface thereof, with an insertion opening 16 through which laundry may be inserted into the drum 12, and a hinge member 18 is installed outside the insertion opening 16.

The hinge member 18 includes a hinge plate 18*a* coupled to the front surface of the main body 10 and hinge arms 18*b* protruding from the hinge plate 18*a*.

A door 100 is rotatably coupled to the hinge arms 18*b* of the hinge member 18 so as to open and close the insertion opening 16.

Hereinafter, a structure of the door 100 will be described.

Figure 3:
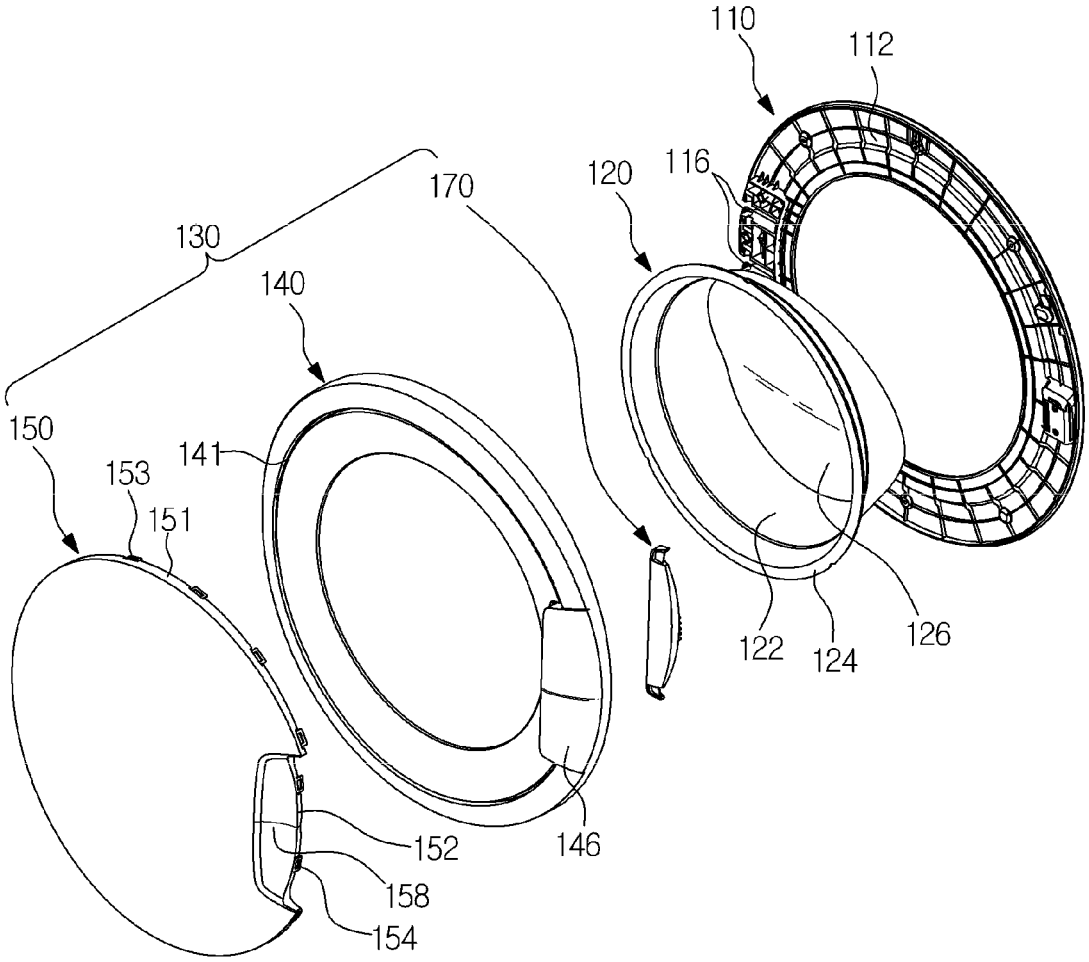
FIG. 3 is an exploded perspective view of the door.
Figure 4:
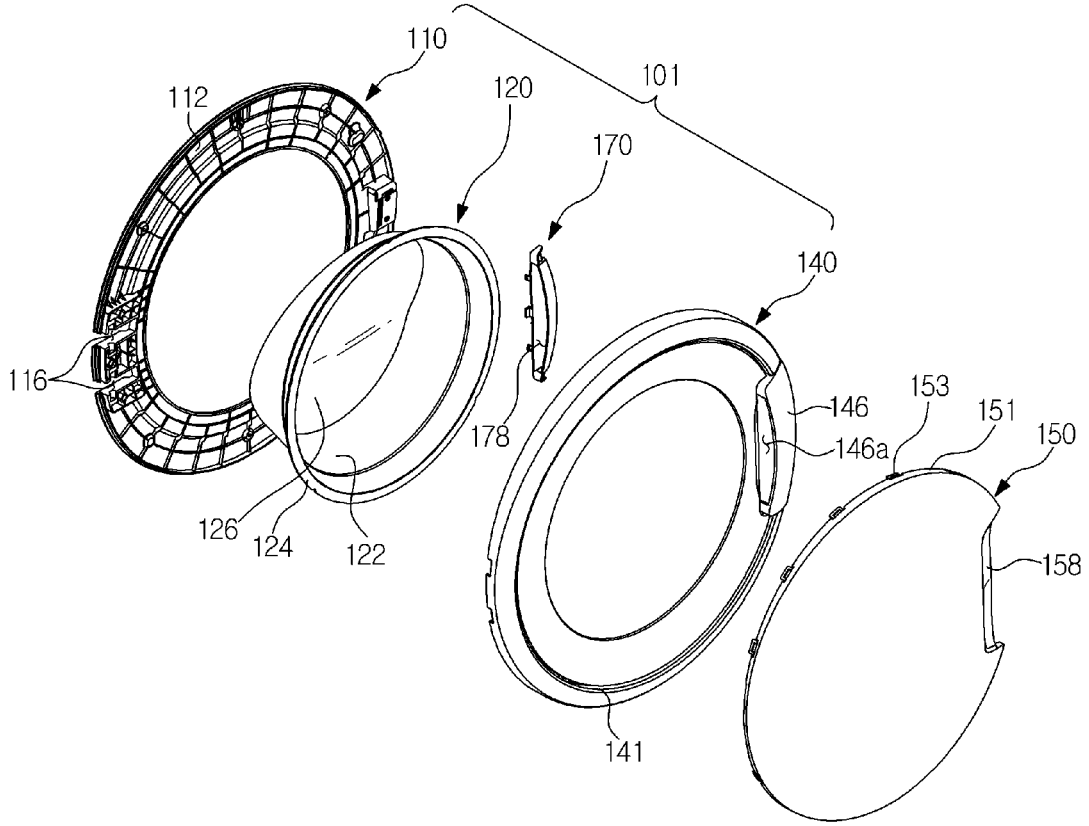
FIG. 4 is an exploded perspective view of the door in FIG. 3 when viewed from another angle.
Figure 5:
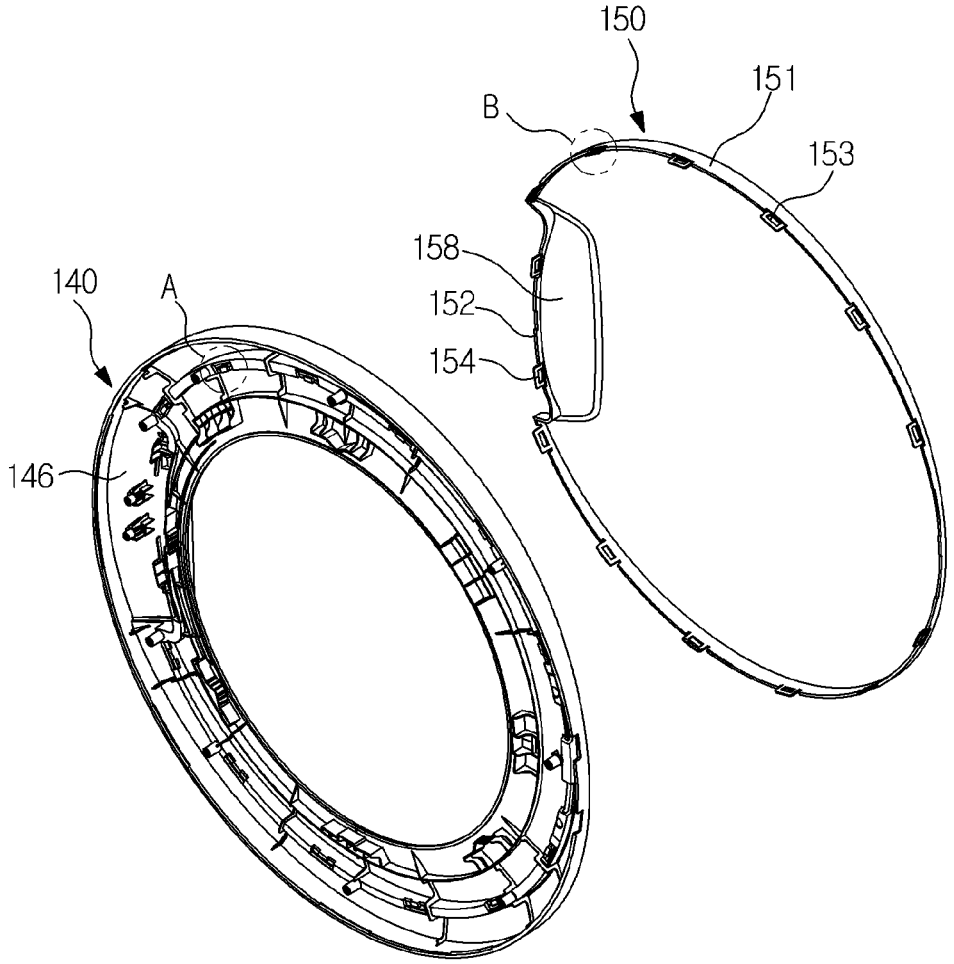
FIG. 5 is a perspective view illustrating a cover frame and a cover panel when viewed from the rear.

FIG. 3 is an exploded perspective view of the door. FIG. 4 is an exploded perspective view of the door in FIG. 3 when viewed from another angle. FIG. 5 is a perspective view illustrating a cover frame and a cover panel when viewed from the rear.

As shown in FIGS. 3 to 5, the door 100 of the clothes treating apparatus includes a holder member 110 rotatably coupled to the hinge member 18, a transparent member 120 coupled to the holder member 110 to close a hollow central portion of the holder member 110, and a cover member 130 to cover a front surface of the holder member 110.

The holder member 110 includes a disc-shaped holder body portion 112 having the hollow central portion and receiving grooves 116 formed at one side of the holder body portion 112. One end of each of the hinge arms 18*b* is received in and coupled to the associated receiving groove 116.

The transparent member 120 is made of transparent glass or plastic. The transparent member 120 includes a circular-shaped transparent body portion 122 opened at the front thereof, a flange portion 124 formed along an outer peripheral surface of the transparent body portion 122 so that the transparent member 120 may be coupled to the holder member 110, and a guide portion 126 obliquely formed at the rear of the transparent body portion 122. The guide portion 126 guides wash water used in washing operation toward the drum 12 and prevents laundry from being concentrated at the front of the drum 12 during a washing operation. The transparent member 120 is not limited to being made of transparent glass or plastic, and may be made of any suitable material, including non-transparent materials.

The cover member 130 defines an external appearance of the door 100 and is coupled to the holder member 110 so as to cover the front surface of the holder member 110. A cover frame 140 of the cover member 130 is coupled to the front surface of the holder member 110 to form a door body 101 together with the holder member 110 and the transparent member 120.

The holder member 110 and the cover member 130 may be injection-molded using lightweight plastic having a certain degree of rigidity or more.

Hereinafter, a structure of the cover member 130 will be described.

Figure 6:
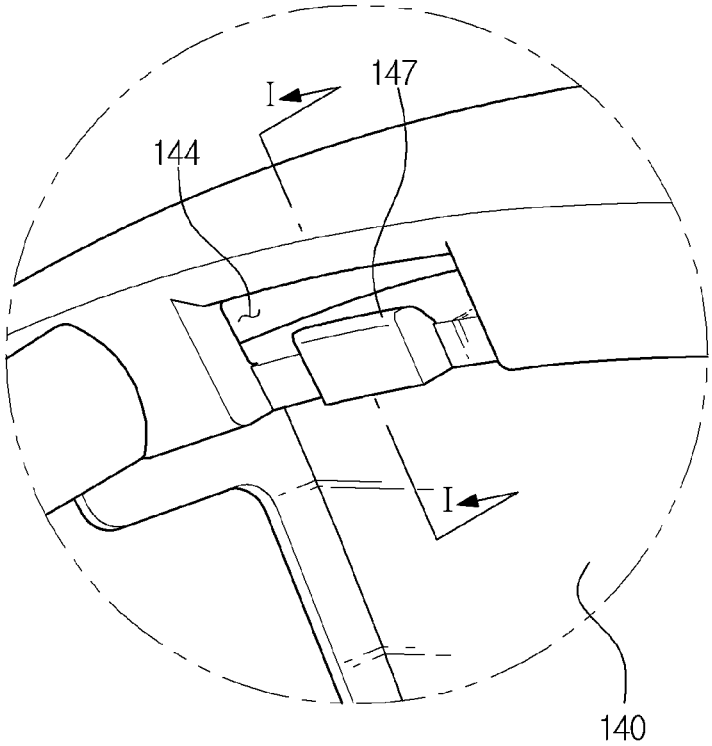
FIG. 6 is an enlarged view of portion "A" in FIG. 5.
Figure 7:
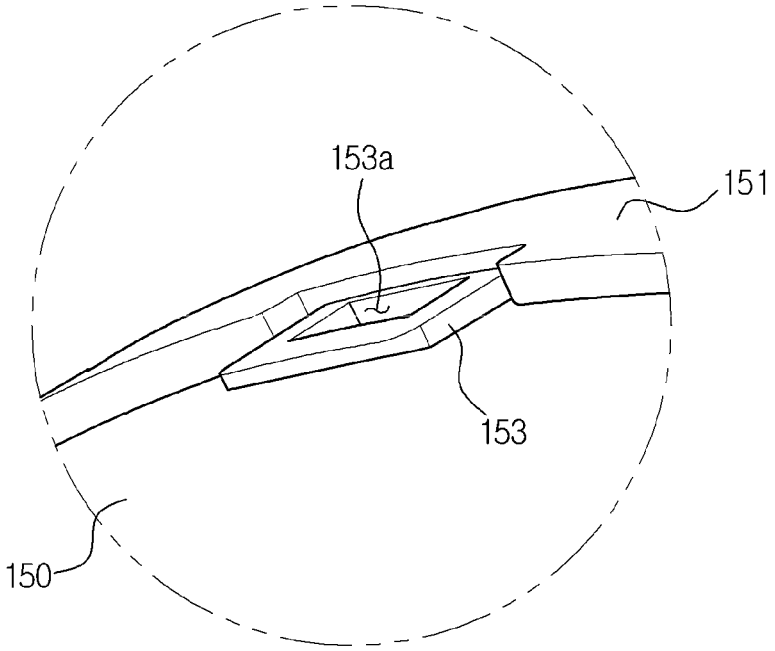
FIG. 7 is an enlarged view of portion "B" in FIG. 5.
Figure 8:
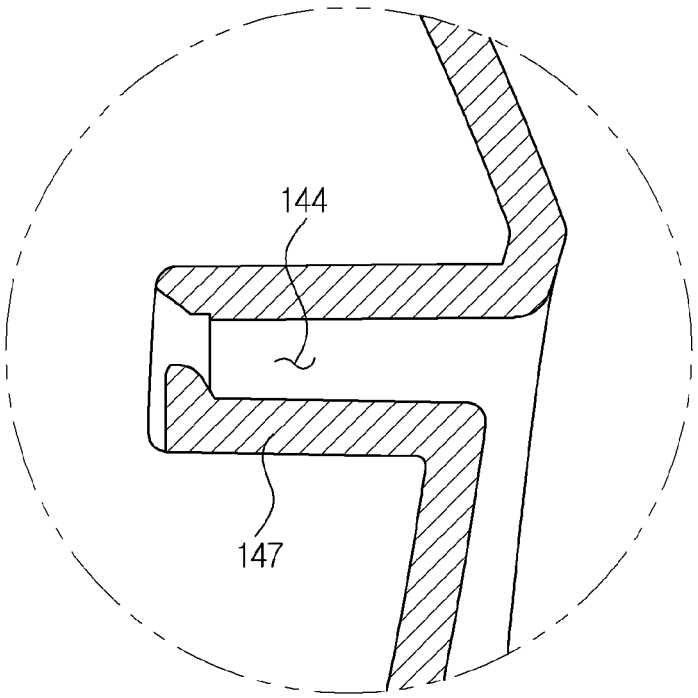
FIG. 8 is a cross-sectional view taken along line "I-I" in FIG. 6.
Figure 9:
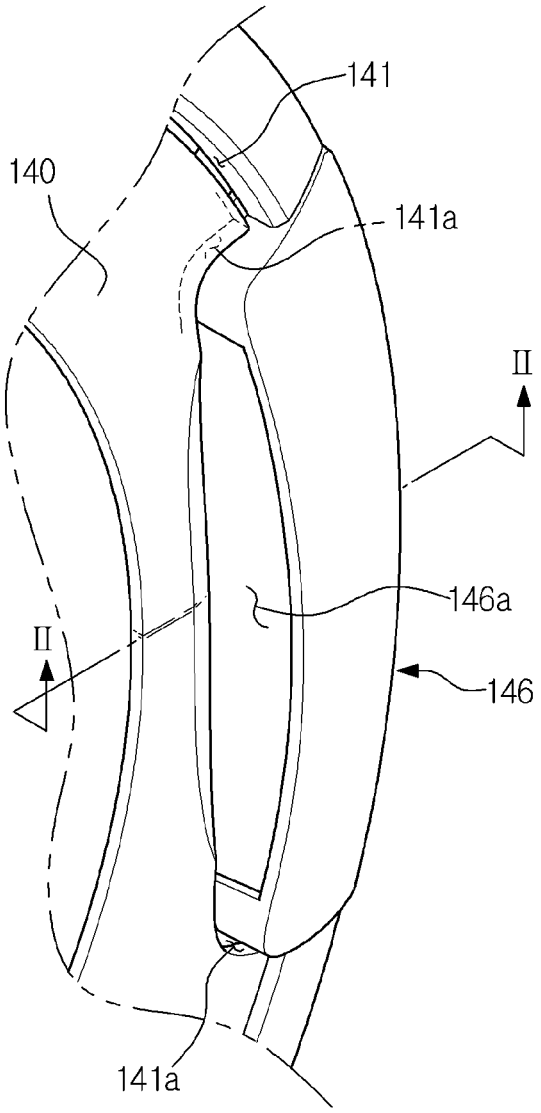
FIG. 9 is an enlarged view illustrating a protrusion portion of the cover frame shown in FIG. 4.
Figure 10:
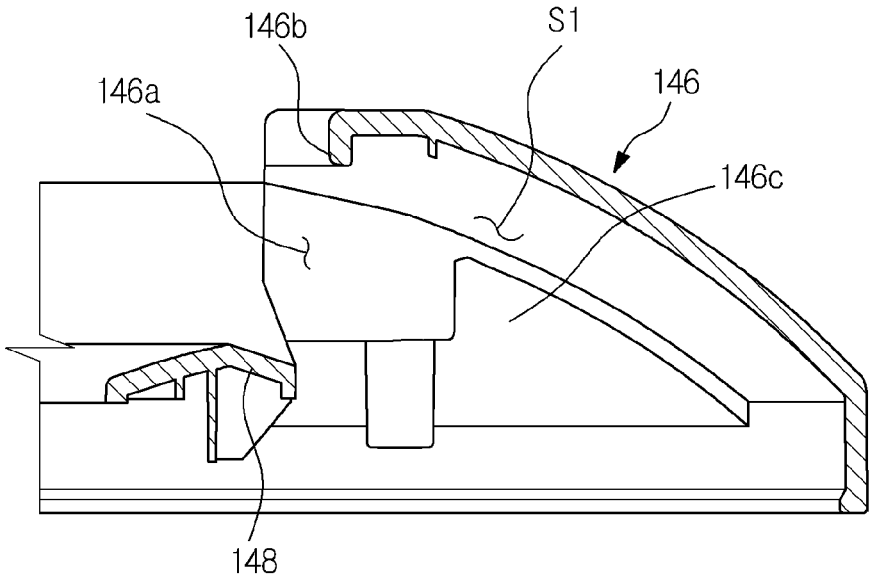
FIG. 10 is a cross-sectional view taken along line "II-II" in FIG. 9.
Figure 11:
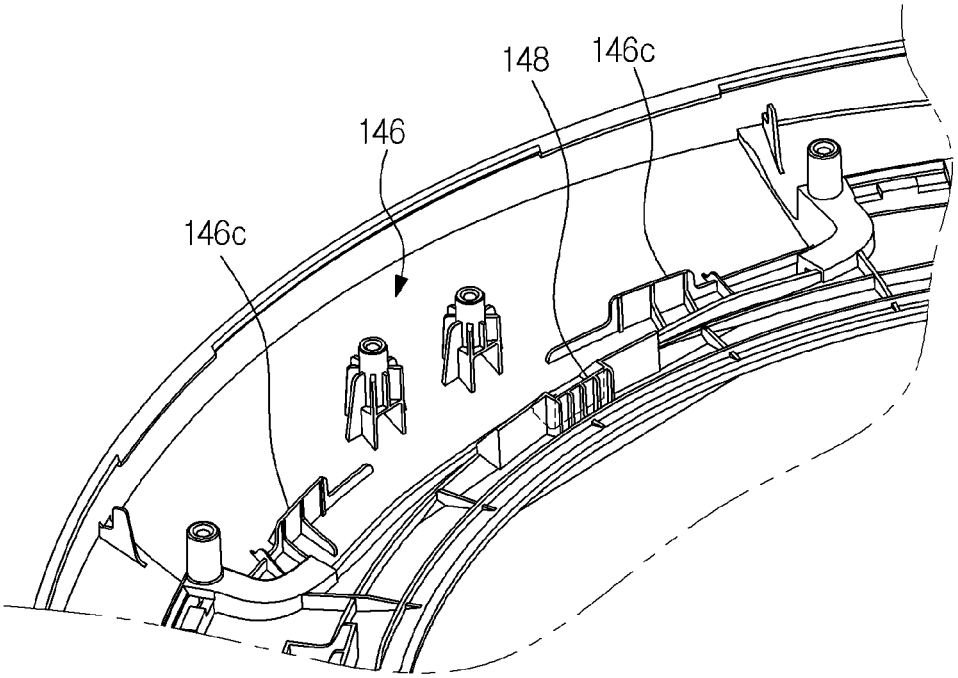
FIG. 11 is a view illustrating a back surface of a portion in which the protrusion portion is formed in the cover frame.
Figure 12:
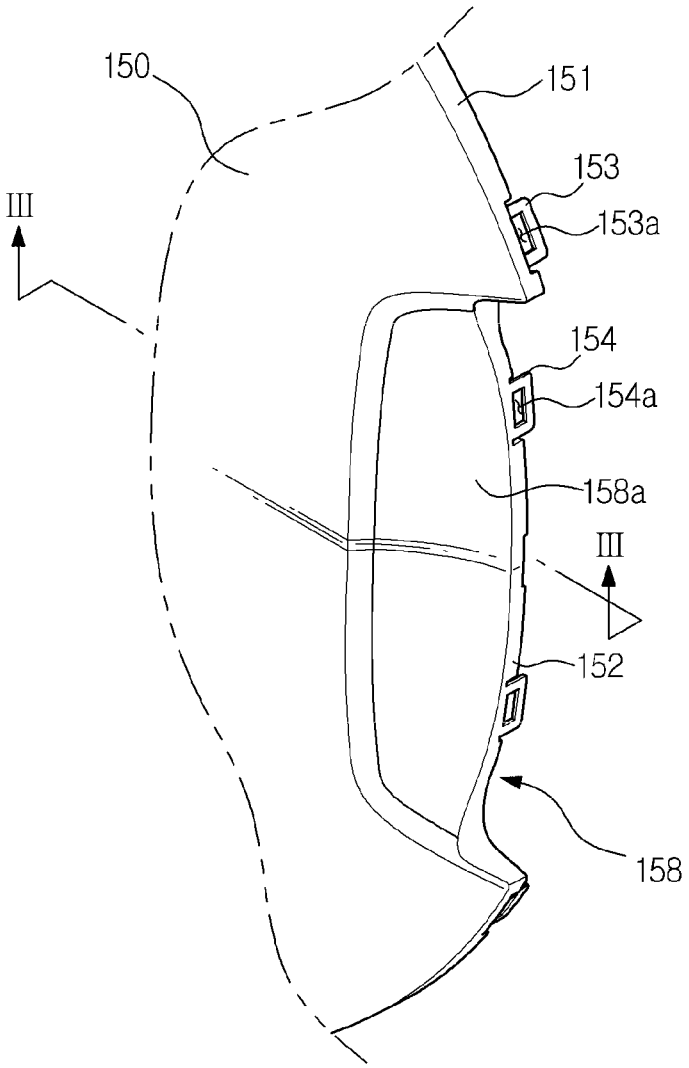
FIG. 12 is an enlarged view illustrating a hand guide of the cover panel shown in FIG. 3.
Figure 13:
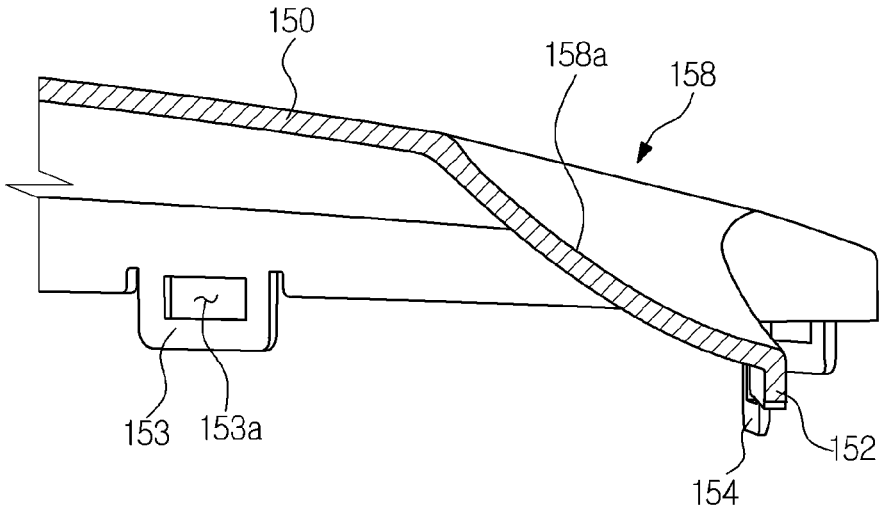
FIG. 13 is a cross-sectional view taken along line "III-III" in FIG. 12.
Figure 14:
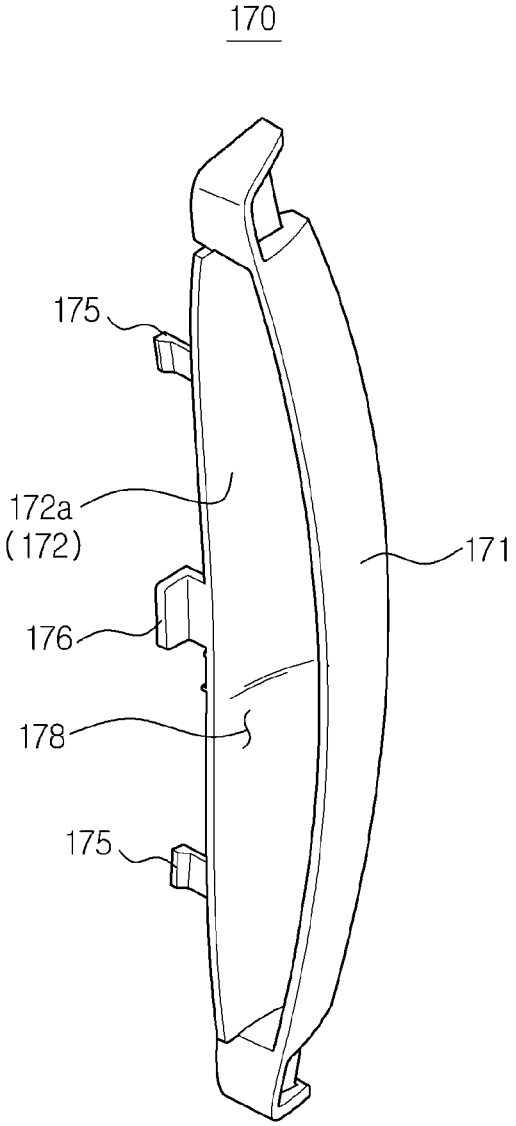
FIG. 14 is an enlarged perspective view illustrating a hand receiving portion.

FIG. 6 is an enlarged view of portion "A" in FIG. 5. FIG. 7 is an enlarged view of portion "B" in FIG. 5. FIG. 8 is a cross-sectional view taken along line "I-I" in FIG. 6. FIG. 9 is an enlarged view illustrating a protrusion portion of the cover frame shown in FIG. 4. FIG. 10 is a cross-sectional view taken along line "II-II" in FIG. 9. FIG. 11 is a view illustrating a back surface of a portion in which the protrusion portion is formed in the cover frame. FIG. 12 is an enlarged view illustrating a hand guide of the cover panel shown in FIG. 3. FIG. 13 is a cross-sectional view taken along line "III-III" in FIG. 12. FIG. 14 is an enlarged perspective view illustrating a hand receiving portion.

As shown in FIGS. 3 to 14, the cover member 130 includes a cover frame 140 provided in a shape corresponding to the holder member 110, a cover panel 150 coupled to a front surface of the cover frame 140 to close a hollow central portion of the cover frame 140, and a hand receiving portion 170 coupled to the cover frame 140 and the cover panel 150 to form a door handle 160 (see FIG. 15) together with the cover frame 140 and the cover panel 150.

The cover frame 140 is provided in a disc shape having the hollow central portion and forms the door body 101 together with the holder member 110 and the transparent member 120.

The front surface of the cover frame 140 is formed with a first insertion groove 141 in a circumferential direction of the cover frame 140. A portion 141*a* of the first insertion groove 141 is formed along a portion around a protrusion portion 146.

A first flange portion 151 of the cover panel 150 is inserted into the first insertion groove 141. In order to compensate for an assembly tolerance between the cover frame 140 and the cover panel 150 and reduce impact noise which may be caused between the cover frame 140 and the cover panel 150 due to the assembly tolerance therebetween, the first insertion groove 141 may have a depth varying according to the circumferential direction of the cover frame 140. The first insertion groove 141 is provided with though-holes 144 through which first fastening protrusions 153 pass. The though-holes 144 are arranged to be spaced apart from each other in the circumferential direction of the cover frame 140.

One side of the cover frame 140 is provided with the protrusion portion 146 forming a portion of the door handle 160. The protrusion portion 146 is configured such that the front surface of the cover frame 140 protrudes to provide a receiving space S1 on a rear surface of the cover frame 140.

The protrusion portion 146 includes a second opening 146*a* opened at one side thereof. The second opening 146*a* has an elongated shape in the circumferential direction of the cover frame 140 and communicates with a first opening 178 such that the first opening 178 of the hand receiving portion 170 may be exposed.

In addition, the protrusion portion 146 includes a first support rib 146*b* which is bent from one end of the protrusion portion 146 formed with the second opening 146*a* to the rear of the door 100, and a second support rib 146*c* which extends from an inner surface of the protrusion portion 146 to the rear of the door 100. A first sidewall 171 of the hand receiving portion 170 is supported radially outward of the door 100 by the first support rib 146*b*, and a third sidewall 173 of the hand receiving portion 170 is supported radially inward of the door 100 by the second support rib 146*c*.

The rear surface of the cover frame 140 is formed with first fastening hooks 147 to fix the cover panel 150 and a third support rib 148 to support the hand receiving portion 170. Each of the first fastening hooks 147 is coupled to a first fastening hole 153*a* formed at each of the first fastening protrusions 153. The third support rib 148 is coupled to a support protrusion 176 protruding from an outer surface of a second sidewall 172 of the hand receiving portion 170 to support the second sidewall 172 so that a stepped region is not formed between an inner surface 172*a* of the second sidewall 172 and a recessed portion 158 of the cover panel 150 or the inner surface 172*a* of the second sidewall 172 at least does not protrude farther than the recessed portion 158.

The cover panel 150 is provided in a disc shape and may be formed of transparent plastic, but is not limited to transparent plastic. The cover panel 150 allows the transparent member 120 to be exposed in a closed state of the door 100 by covering the hollow central portion of the cover frame 140. When temperature in the drum 12 increases during a washing operation, temperature around the transparent member 120 adjacent to the inside of the drum 12 also increases. The cover panel 150 allows the transparent member 120 to be exposed to the outside in order to prevent a user from suffering burns due to contact with the transparent member 120.

The cover panel 150 includes the recessed portion 158 recessed at a portion of the front surface thereof. The recessed portion 158 includes a recessed surface 158*a* which is naturally connected to the inner surface 172*a* of the second sidewall 172 to guide a user's hand into the hand receiving portion 170.

In addition, the cover panel 150 includes a first flange portion 151 formed such that a tip of the cover panel 150 is bent to the rear of the door 100, and a second flange portion 152 formed such that a tip of the recessed portion 158 is bent to the rear of the door 100. The first and second flange portions 151 and 152 are connected to each other. The first flange portion 151 is inserted into the first insertion groove 141 and the second flange portion 152 is inserted into a second insertion groove 142 formed between the cover frame 140 and the hand receiving portion 170.

The first flange portion 151 is provided with the first fastening protrusions 153 each of which extends rearward from a tip of the first flange portion 151. The first fastening protrusions 153 are arranged to be spaced apart from each other in a circumferential direction of the cover panel 150. The first fastening protrusions 153 pass through the though-holes 144 formed in the first insertion groove 141 of the cover frame 140 to be fixed to the cover frame 140. At least one first fastening hole 153*a* to which the associated first fastening hook 147 of the cover frame 140 is coupled is formed in the first fastening protrusion 153. The first fastening hole 153*a* is formed by penetrating a portion of the first fastening protrusion 153 such that the first fastening hook 147 may be caught by and fixed to the first fastening hole 153*a*.

The second flange portion 152 is provided with second fastening protrusions 154 each of which extends rearward from a tip of the second flange portion 152. The second fastening protrusions 154 are arranged to be spaced apart from each other in the circumferential direction of the cover panel 150. The second fastening protrusions 154 pass through the second insertion groove 142 to be coupled to the hand receiving portion 170. At least one second fastening hole 154*a* to which an associated second fastening hook 175 of hand receiving portion 170 is coupled is formed in the second fastening protrusion 154. The second fastening hole 154*a* is formed by penetrating a portion of the second fastening protrusion 154 such that the second fastening hook 175 may be caught by and fixed to the second fastening hole 154*a*.

The hand receiving portion 170 is provided in a shape opened at one side thereof, and is received in and fixed to the receiving space S1 defined by the protrusion portion 146.

The hand receiving portion 170 includes the first sidewall 171 and the second sidewall 172 which are spaced apart from each other in forward and backward directions of the door 100 to form the first opening 178, and the third sidewall 173 (see FIG. 18) connecting the first and second sidewalls 171 and 172.

The first opening 178 is generally arranged toward the center of the door 100 such that a user's hand may be inserted from radially outward of the door 100 into the hand receiving portion 170. The first sidewall 171 is supported radially outward of the door 100 by the first support rib 146*b* and the third sidewall 173 is supported radially inward of the door 100 by the second support rib 146*c*. Accordingly, the hand receiving portion 170 is stably supported by the first and second support ribs 146*b* and 146*c* in a state of being received in the receiving space S1.

The second sidewall 172 is provided with the second fastening hooks 175 and the support protrusion 176 which protrude from the outer surface of the second sidewall 172 to the rear of the door 100. The support protrusion 176 is disposed between the second fastening hooks 175. Each of the second fastening hooks 175 is coupled to the second fastening protrusion 154 through the second fastening hole 154*a* and the support protrusion 176 is supported by the third support rib 148. That is, the hand receiving portion 170 is coupled to the cover panel 150 through the second fastening hook 175 and is supported through the support protrusion 176 by the cover frame 140.

The inner surface 172*a* of the second sidewall 172 is disposed such that a stepped region is not formed between the inner surface 172*a* of the second sidewall 172 and the recessed surface 158*a* of the cover panel 150 or the inner surface 172*a* of the second sidewall 172 at least does not protrude farther than the recessed portion 158. The inner surface 172*a* of the second sidewall 172 has a radius of curvature R1 substantially equal to a radius of curvature R2 of the recessed surface 158*a* such that the inner surface 172*a* of the second sidewall 172 is naturally connected to the recessed surface 158*a* of the cover panel 150. As described above, the stepped region is not formed between the inner surface 172*a* of the second sidewall 172 and the recessed surface 158*a*, or the inner surface 172*a* of the second sidewall 172 at least does not protrude farther than the recessed portion 158, so that the inner surface 172*a* of the second sidewall 172 is naturally connected to the recessed surface 158*a*. Consequently, a user's hand is prevented from suffering injuries in a process of being accommodated into the hand receiving portion 170 along the recessed surface 158*a*. The second sidewall 172 is spaced apart from the third support rib 148 in the radial direction of the door 100, and the second insertion groove 142 is formed between the second sidewall 172 and the third support rib 148. The second flange portion 512 of the cover panel 150 is inserted into the second insertion groove 142.

The hand receiving portion 170 may be injection-molded using plastic. In a case of general injection-molded plastic products, the products are deformed in shape due to residual stress remaining in the products after injection molding. Accordingly, in a case of the hand receiving portion 170, the second sidewall 172 may be deformed in a direction close to the first sidewall 171 due to shape characteristics of the hand receiving portion 170. As described above, since the support protrusion 176 extending from the second sidewall 172 is supported by the third support rib 148 so as to prevent shape deformation of the second sidewall 172, the stepped region is not formed between the inner surface 172*a* of the second sidewall 172 and the recessed surface 158*a* of the cover panel 150 or the inner surface 172*a* of the second sidewall 172 at least does not protrude farther than the recessed portion 158, so that the inner surface 172*a* of the second sidewall 172 is naturally connected to the recessed surface 158*a* of the cover panel 150.

Hereinafter, a structure of the door handle 160 will be described.

Figure 15:
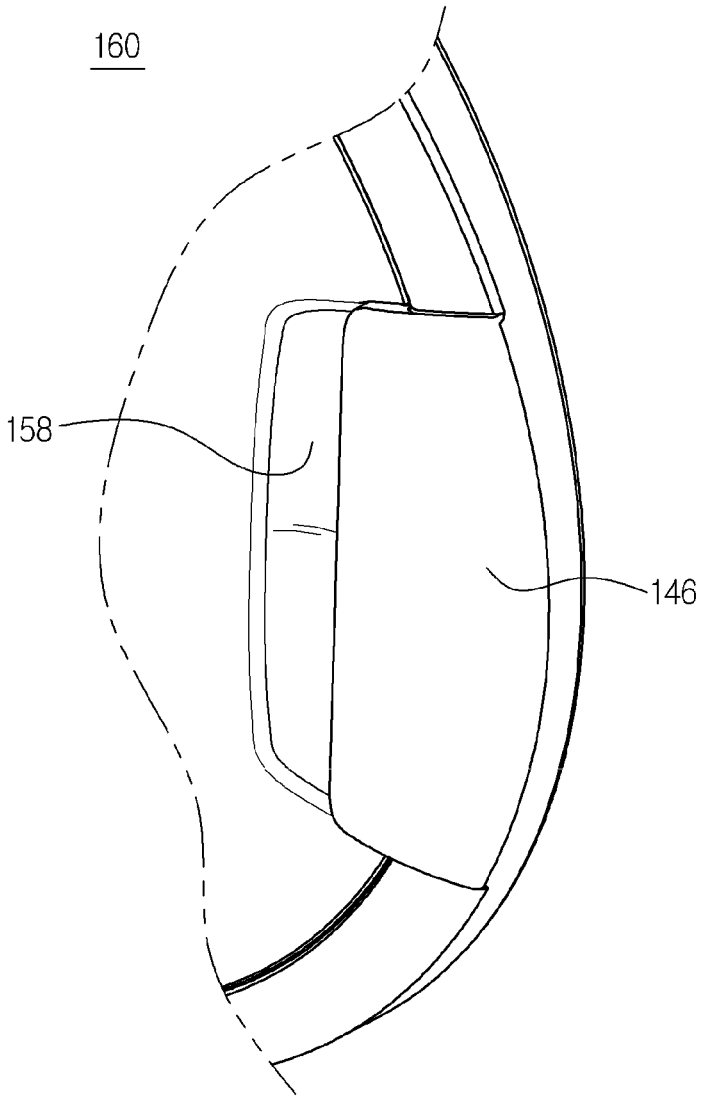
FIG. 15 is a perspective view illustrating a door handle separated from the door.
Figure 16:
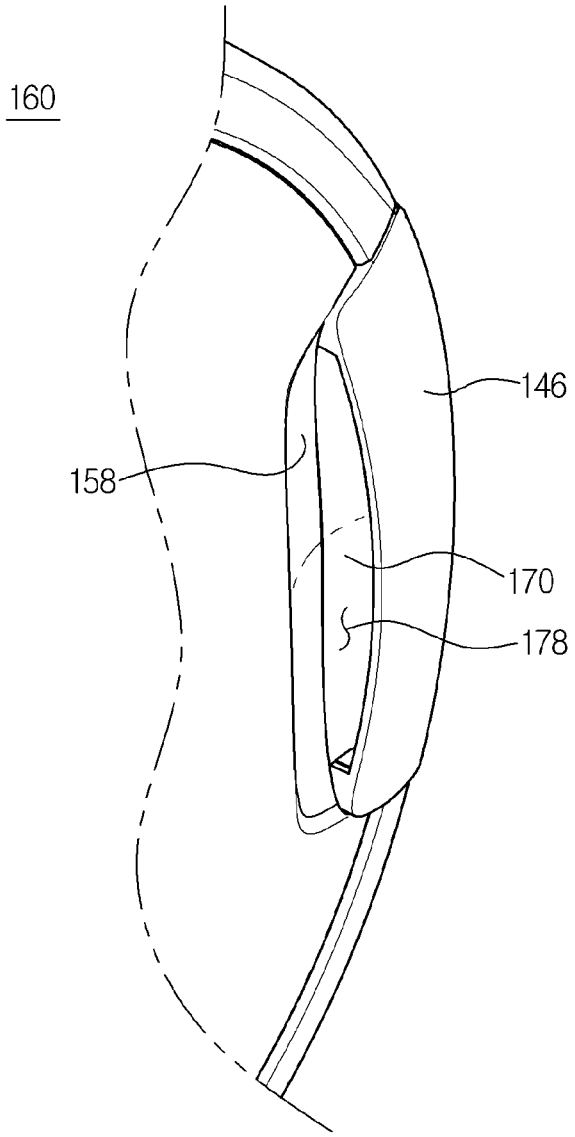
FIG. 16 is a perspective view of the door handle in FIG. 15 when viewed from another angle.
Figure 17:
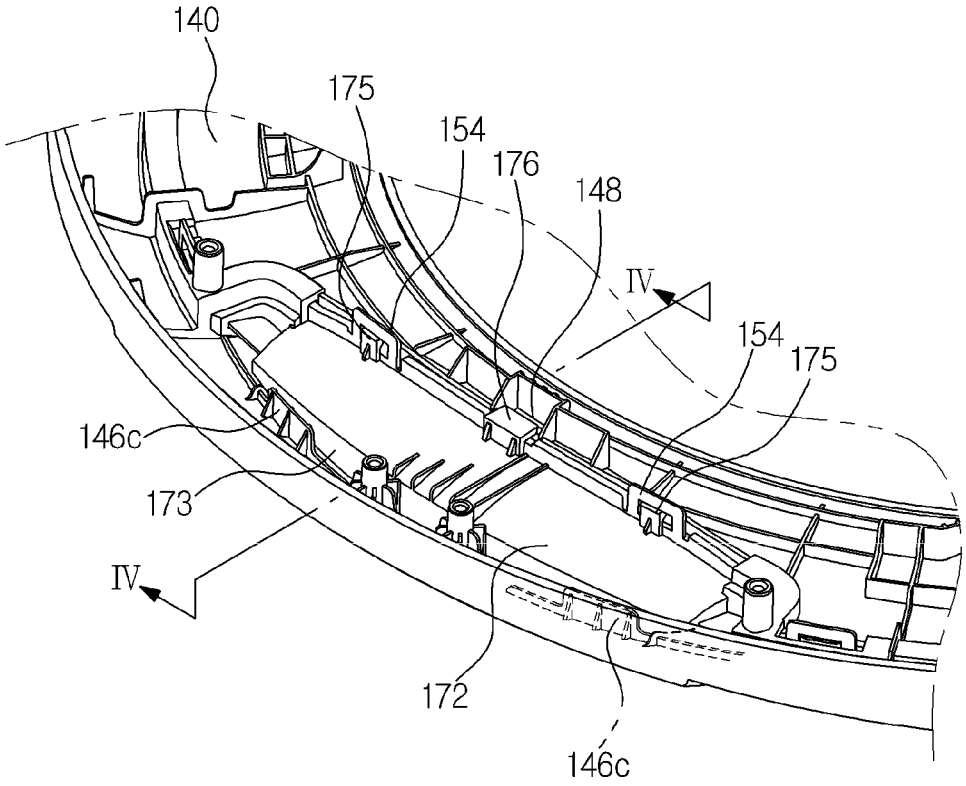
FIG. 17 is a back perspective view illustrating the door handle in FIG. 16.
Figure 18:
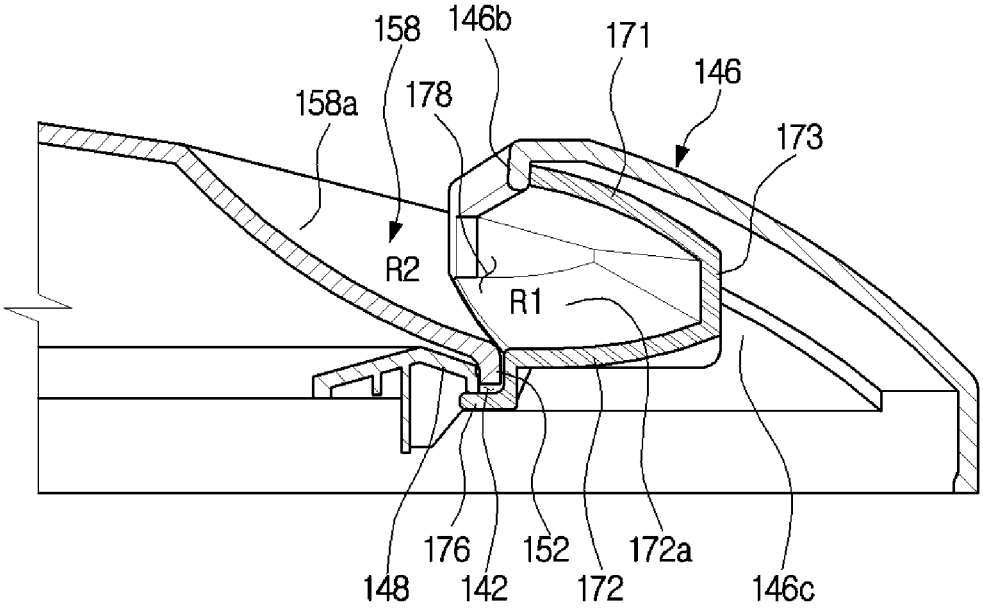
FIG. 18 is a cross-sectional view taken along line "IV-IV" in FIG. 17.
Figure 19:
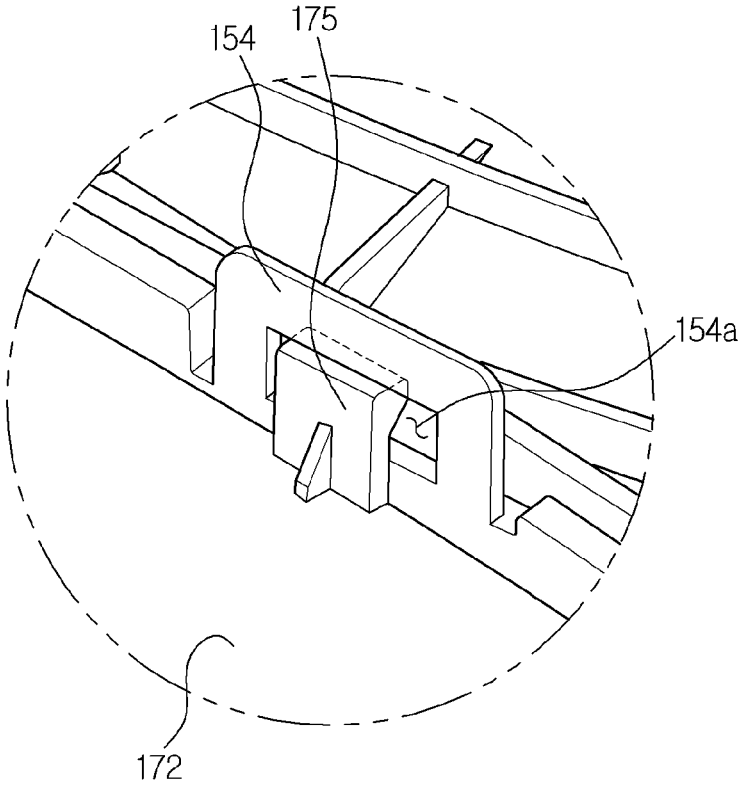
FIG. 19 is an enlarged view illustrating a coupling relation between a second fastening hook of the hand receiving portion and a second fastening hole of the cover panel.

FIG. 15 is a perspective view illustrating the door handle separated from the door. FIG. 16 is a perspective view of the door handle in FIG. 15 when viewed from another angle. FIG. 17 is a back perspective view illustrating the door handle in FIG. 16. FIG. 18 is a cross-sectional view taken along line "IV-IV" in FIG. 17. FIG. 19 is an enlarged view illustrating a coupling relation between the second fastening hook of the hand receiving portion and the second fastening hole of the cover panel.

As shown in FIGS. 15 to 19, the door handle 160 includes the protrusion portion 146 of the cover frame 140, the recessed portion 158 of the cover panel 150, and the hand receiving portion 170.

The external appearance of the door handle 160 is defined by the protrusion portion 146 of the cover frame 140 and the recessed portion 158 of the cover panel 150. Hereinafter, a first door handle forming portion has the same configuration as the protrusion portion 146 and a second door handle forming portion has the same configuration as the recessed portion 158.

The first door handle forming portion 146 is formed such that the front surface of the cover frame 140 protrudes so as to receive the hand receiving portion 170, and includes the second opening 146*a* opened toward the center of the cover frame 140. The second opening 146*a* communicates with the first opening 178 of the hand receiving portion 170.

The second door handle forming portion 158 is the recessed portion 158 recessed at a portion of the front surface thereof such that a user's hand may be naturally guided to the hand receiving portion 170 in a process in which the door handle 160 is gripped by a user. The recessed surface 158*a* of the recessed portion 158 forms the same substantially curved surface as the inner surface 172 at one side of the hand receiving portion 170.

The hand receiving portion 170 is received and fixed inside the first door handle forming portion 146, and includes the first opening 178 communicating with the second opening 146*a*. The first opening 178 allows a user's hand to be inserted into the hand receiving portion 170. The hand receiving portion 170 is supported in respective directions different from each other by the first support rib 146*b*, the second support rib 146*c*, and the third support rib 148 which are formed in the first door handle forming portion 146.

After a user's hand is inserted into the hand receiving portion 170 through the first and second openings 178 and 146*a* along the recessed portion 158, a user may open the insertion opening 16 by pulling the door 100.

As described above, the door handle 160 is formed integrally with the cover frame 140 and the cover panel 150 defining the external appearance of the door 100. Therefore, it may be possible to reduce additional costs for separate production of the door handle 160 and to eliminate processes of coupling a separately produced door handle 160 to the door 100, thereby enhancing productivity of the door 100.

Figure 20:
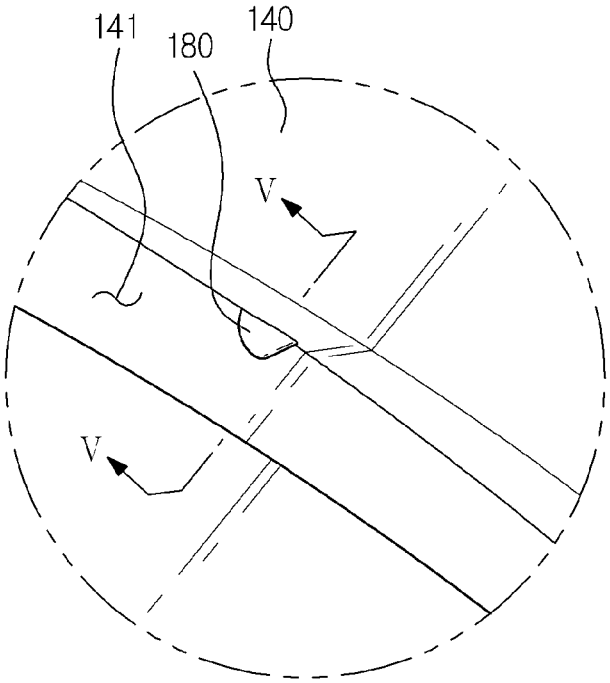
FIG. 20 is an enlarged view illustrating a portion of a first insertion groove formed in the cover frame.
Figure 21:
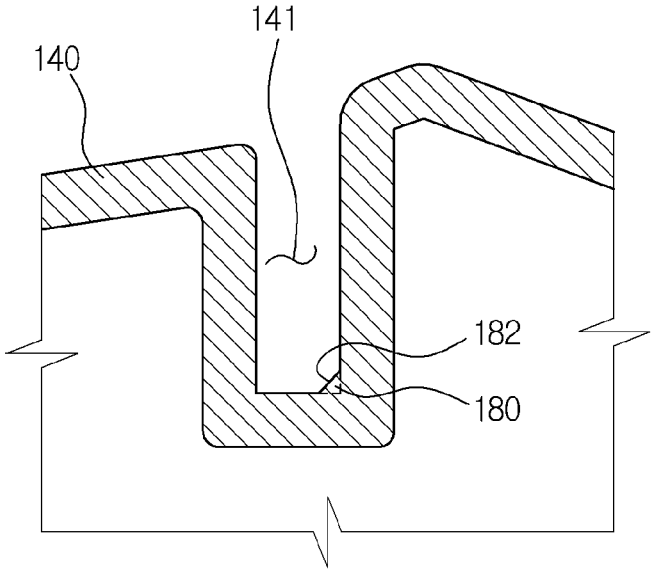
FIG. 21 is a cross-sectional view taken along line "V-V" in FIG. 20.
Figure 22:
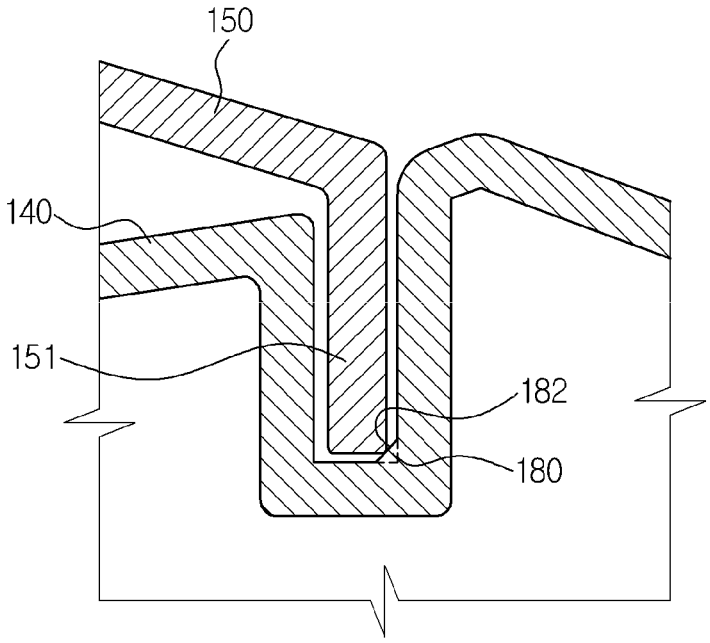
FIG. 22 is a view illustrating a state in which a first flange portion of the cover panel is inserted into the first insertion groove.

FIG. 20 is an enlarged view illustrating a portion of the first insertion groove formed in the cover frame. FIG. 21 is a cross-sectional view taken along line "V-V" in FIG. 20. FIG. 22 is a view illustrating a state in which the first flange portion of the cover panel is inserted into the first insertion groove.

As shown in FIGS. 20 to 22, the first insertion groove 141 is provided with an inclined rib 180 to support an end of the first flange portion 151 of the cover panel 150.

The inclined rib 180 includes an inclined surface 182 connecting two adjacent inner surfaces of the first insertion groove 141. The inclined surface 182 comes into contact with and supports the end of the first flange portion 151, and decreases a contact area between the end of the first flange portion 151 and the inner surfaces of the first insertion groove 141. Consequently, it may be possible to compensate for an assembly tolerance between the first insertion groove 141 and the first flange portion 151 and to reduce impact noise which may be caused between the cover frame 140 and the cover panel 150 due to the assembly tolerance therebetween.

The door handle 160 described above may also be similarly applied to a door used for a clothes treating apparatus such as a dryer, as well as a washing machine.

As is apparent from the above description, in accordance with embodiments of the present disclosure, since a door is formed integrally with a door handle, material costs may be reduced.

In addition, productivity of the door may be enhanced.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A clothes treating apparatus comprising:

a main body having a laundry insertion opening formed on a front side of the main body; and a door to open or close the laundry insertion opening, the door comprising:

a frame having a central opening, the frame having a hand receiver accommodation space and a side opening accessible to the hand receiver accommodation space;

a hand receiver having a shape insertable into the side opening thereby being accommodated in the hand receiver accommodation space and having a concave hand receiving space; and a panel coupled to a front side of the frame to cover the central opening of the frame, the panel having a recessed portion, recessed from a front surface of the panel, disposed to provide access to the concave hand receiving space of the hand receiver, wherein the recessed portion includes a recessed surface which connects to an inner surface of the hand receiver to guide a user's hand into the hand receiver.

2. The clothes treating apparatus according to claim 1, wherein the hand receiver comprises a first side, a second side spaced apart from the first, and a third side connecting the first side and the second side, so that inner surfaces of the first side, the second side and the third side thereby form the concave hand receiving space of the hand receiver, and outer surfaces of the first side, the second side and the third side are insertable into the side opening thereby be accommodated in the hand receiver accommodation space.

3. The door according to claim 2, wherein the frame is a ring shaped frame.

4. The clothes treating apparatus according to claim 1, wherein the door further comprises a holder member coupled to a rear side of the frame.

5. The clothes treating apparatus according to claim 1, wherein the panel further includes a flange portion, and the frame further includes an insertion groove to receive the flange portion.

6. The clothes treating apparatus according to claim 5, wherein the flange portion includes a fastening protrusion, and the insertion groove includes a through-hole to receive the fastening protrusion.

7. The clothes treating apparatus according to claim 1, wherein the side opening is extended in a circumferential direction of the frame, and the recessed portion of the panel is disposed to correspond to the side opening of the frame.

8. The door according to claim 1, wherein the frame is a ring shaped frame.

9. A door to open or close a laundry insertion opening of a clothes treating apparatus, comprising:

a frame having a central opening, the frame having a hand receiver accommodation space and a side opening accessible to the hand receiver accommodation space;

a holder coupled to a rear side of the frame;

a hand receiver having a shape insertable into the side opening thereby being accommodated in the hand receiver accommodation space, and having a concave hand receiving space; and a panel coupled to a front side of the frame to the central opening of the frame, the panel having a recessed portion, recessed from a front surface of the panel, disposed to provide access to the concave hand receiving space of the hand receiver, wherein the recessed portion includes a recessed surface which connects to an inner surface of the hand receiver to guide a user's hand into the hand receiver.

10. The door according to claim 9, wherein the hand receiver comprises a first side, a second side spaced apart from the first side, and a third side connecting the first side and the second side so that inner surfaces of the first side, the second side, and the third side thereby form the concave hand receiving space of the hand receiver and outer surfaces of the first side, the second side and the third side are insertable into the side opening thereby be accommodated in the hand receiver accommodation space.

11. The door according to claim 9, wherein the panel further includes a flange portion, and the frame further includes an insertion groove to receive the flange portion.

12. The door according to claim 11, wherein the flange portion includes a fastening protrusion, and the insertion groove includes a through-hole to receive the fastening protrusion.

13. The door according to claim 9, wherein the side opening is extended in a circumferential direction of the frame, and the recessed portion of the panel is disposed to correspond to the side opening of the frame.

* * * * *